United States Patent [19]

Bengsch

[11] Patent Number: 4,771,539

[45] Date of Patent: Sep. 20, 1988

[54] DEVICE FOR HANDLING PACKAGING CONTAINERS MADE OF CARDBOARD OR SIMILAR MATERIAL

[76] Inventor: Peter Bengsch, Mosseveien 152, Oslo 11, Norway

[21] Appl. No.: 148,734

[22] Filed: Jan. 26, 1988

[30] Foreign Application Priority Data

Jun. 23, 1987 [NO] Norway ..... 872621

[51] Int. Cl.[4] ..... B65D 5/46

[52] U.S. Cl. ..... 30/123; 7/158; 294/33

[58] Field of Search ..... 30/123, 2; 7/158; 229/52 A, 52 AM, 123.2; 294/33

[56] References Cited

U.S. PATENT DOCUMENTS

| | | | |
|---|---|---|---|
| 2,775,815 | 1/1957 | Thompson | 30/123 |
| 3,427,065 | 2/1969 | Epstein | 229/52 AM X |
| 3,803,713 | 4/1974 | Jones et al. | 30/123 |

*Primary Examiner*—Donald F. Norton
*Attorney, Agent, or Firm*—Jordan and Hamburg

[57] ABSTRACT

A device for handling packaging containers having a parallelepiped shape, made of cardboard or a similar material, which have a folded closure on a frontal surface, outer corners of which, projecting beyond sides of the frontal surface, form a folded triangle, the base of which corresponds to one edge of the frontal surface and the tip of which is attached to a lateral surface of the parallelepiped. A guide slit holds part of the closure fold and a cutting blade overlaps the guide slit. A frame surrounds the parallelepiped at least partially on four lateral surfaces and has a handle aligned approximately vertically to the plane of the frame on one frame section and a catch to engage under one of the folded triangles folded down against the lateral surface of the parallelepiped. The frame also has the guide slit with the knife in another frame section.

20 Claims, 3 Drawing Sheets

DEVICE FOR HANDLING PACKAGING CONTAINERS MADE OF CARDBOARD OR SIMILAR MATERIAL

BACKGROUND OF THE INVENTION

The invention is directed to a device for handling packaging containers with a parallelepiped shape, made of cardboard or a similar material which have a folded closure on a frontal side, outer corners of which, projecting beyond the sides of the frontal surface, form a folded triangle, the base of which corresponds to one edge of the frontal surface of the parallelepiped, the handling device having a guide slit to hold part of the closure fold and a cutting blade which overlaps the guide slit.

Packaging containers made of coated cardboard or a similar material are very popular. They are easy to produce, easy to handle before being filled, and can be disposed of in a particularly non-polluting manner after use. The packaging container is folded from a single pre-cut cardboard shape. Upper and lower frontal surfaces are folded to form a closure and subsequently bonded or glued shut. This results in corners which project laterally beyond the frontal surfaces, in the form of a folded triangle, because of the shape of the pre-cut cardboard. The folded triangular corners are either folded back over the frontal surface or over onto one lateral surface of the parallelepiped, and fixed in this position, e.g., glued. This results in a parallelepiped form which can be easily packaged and can be stacked without problems in units of several individual containers. In use, however, it is somewhat difficult and requires a certain amount of dexterity to open the package in such a way as to prevent part of the contents from exiting and causing contamination. In general use, a folded triangle is loosened from its point of attachment, folded up and cut off. This results in an opening through which the liquid contents can be poured out. As long as the container is closed, it maintains its parallelepiped shape if handled properly. But once it has been opened, it is relatively easy to compress it, especially if it is not handled carefully, so that the liquid is caused to exit the container. To open the container, i.e., to cut off a folded triangle to form a pouring opening, scissors are generally required, since a knife is too impractical. As an aid for this, a flat plate has already been suggested, which has a slit in its longitudinal direction, which is covered by a knife blade in the area of one end. One corner of the closure fold, which has been folded up, is passed through the slit and then the plate is pulled away in a lateral direction, so that the knife blade cuts off the corner which projects through the slit. This measure, however, represents only a substitute for the scissors which are otherwise necessary, without offering any additional advantages for use. It is desirable, however, not only to open the packaging container, but also to be better able to handle it for further use, particularly for emptying it.

SUMMARY OF THE INVENTION

The above-noted and other objects are accomplished by a handling device of the kind described initially, having a frame which surrounds the parallelepiped at least partially on four lateral surfaces, a handle which is approximately vertical to the plane of the frame on one frame section, with a catch to engage under a folded triangle folded down against the lateral surface of the parallelepiped, and the guide slit with the blade on another frame section. The cutting device is therefore no longer an isolated device which can only be used as such, as is the case for the known devices, but rather a part of a support frame which holds the packaging container. The frame supports the packaging container, which is not very able to retain its shape, especially after being opened, with the handle making handling particularly easy. At the same time, the cutting device on the frame is provided in such a way that the cutting process can be carried out easily when the frame is held by its handle. If the packaging container is placed into the frame after being opened, the catch engages under the folded triangle attached on a corresponding surface of the parallelepiped, and thereby results in a firm connection between the frame and the container, in that the latter cannot slip out of the frame in a downward direction. The device can be produced in various sizes, adapted to the container cross-section in each case.

It is within the scope of the basic idea of the invention that the frame has two frame sections which rest against the entire width of the parallelepiped surface in each case, and two shorter frame sections adjacent these. In this way, the frame does not fully surround the packaging container, but does hold it on four sides; on two sides it rests fully against the container and on two sides it rests partially against the container. The frame is therefore open and can be more easily placed over the packaging container. It is most practical to have the handle arranged on a frame section which rests against the entire width of a parallelepiped surface. In this way, there results a particularly high level of stability in handling the device which holds the packaging container.

In another embodiment, the frame has an additional section which rests against part of the frontal surface of the parallelepiped during use, this additional section being provided with a guide slit with a cutting blade. It has proven to be particularly advantageous, however, to arrange the guide slit in one of the frame sections which rests against an entire surface of the packaging container. In the case of packaging containers with a rectangular basic cross-section, this is preferably a frame section which rests against a wide parallelepiped surface. Such a guide slit can then be made long enough to facilitate inserting the folded closure and cutting it off. It has proven to be particularly advantageous to make the arrangement in such a way that the guide slit continues in the adjacent short frame section. This allows the frame which has the guide slit to be easily passed over the folded closure cut off after it has been cut off.

If, as the invention provides according to another characteristic, the free end of at least one of the short frame sections is slightly angled outwards or bent out, in other words if it projects away from the container, placing the frame onto the opened packaging container can be significantly facilitated.

The knife blade overlaps the guide slit and can be attached directly to a frame section. For this, a rivet or screw attachment is suitable, but a clip or a similar closure which can be opened if desired can also be used. It has proven to be particularly advantageous within the scope of the invention, however, to attach the knife blade to a separate knife holder arranged on the frame section. Since the knife blade is subject to wear, and thus has to be replaced as necessary, a separate knife holder facilitates handling significantly. The knife holder can, as the invention provides in a further development, be hinged onto the frame section and formed so that it can be flipped down against the outer surface of the frame section and held in place there. In this case, the knife holder more or less covers the cutting blade on both sides of the guide slit and holds it securely in place. It is particularly practical if the knife holder is made in one piece with the frame section. This significantly facilitates production of the device and contributes to reducing manufacturing costs.

The versatility of the device according to the invention can be further increased by having the knife blade project beyond one longitudinal edge of the frame section. It can be used for additional purposes, e.g. for cutting open a packaging carton. Because of its arrangement on the frame, it acts more or less like a drawing knife. Safety when using such a device is significantly improved if a protective surface which projects beyond the contours of the knife blade is arranged at a distance from the knife blade on the inside of the projecting knife blade. This protective surface covers the projection of the knife blade and thereby eliminates an injury hazard presented by the protecting of the knife. Because of the distance between the protective surface and the knife blade, a packaging carton can be cut directly along one edge when the device is used in the way described above. In this case, the protective surface rests against the edge of the carton directly adjacent to the cut. Finally, the charactistic of a protective cap which can be placed over the projecting knife blade further serves as protection. This cap can, as the invention further provides, have a plate which can be inserted in the space between the knife blade and the protective surface, which has ribs which surround the projecting knife blade on its outer surface. This cap is clamped into place by being inserted into the gap between the knife blade and the protective surface. The ribs shield the knife, particularly the cutting edge, in such a way that the risk of injury is practically excluded.

It has proven to be practical to arrange a hook to grasp under a folded triangle, tear it loose and flip it up, on the outer surface of one of the frame sections. Using this hook, the user of the device grasps under the folded triangle attached to a parallelepiped surface, and is thereby spared the use of a finger or fingernail, which can easily be injured by such grasping.

The device according to the invention can be shaped from a flat sheet-metal bar, most practically by being bent. The frame and the handle can consist of a single piece. Alternatively, the device can be made out of plastic, most practically by injection molding, with the frame and the handle, possibly also the knife holder which is part of this single piece, being formed in a single work process. This solution also allows a connection between the frame and the knife holder in the form of a film hinge.

BRIEF DESCRIPTION OF THE DRAWINGS

Further characteristics, features and advantages of the invention are evident from the following description of some preferred embodiments of the invention and on the basis of the drawings, in which.

DETAILED DESCRIPTION OF THE PREFERRED EMBODIMENTS

Figure 1:
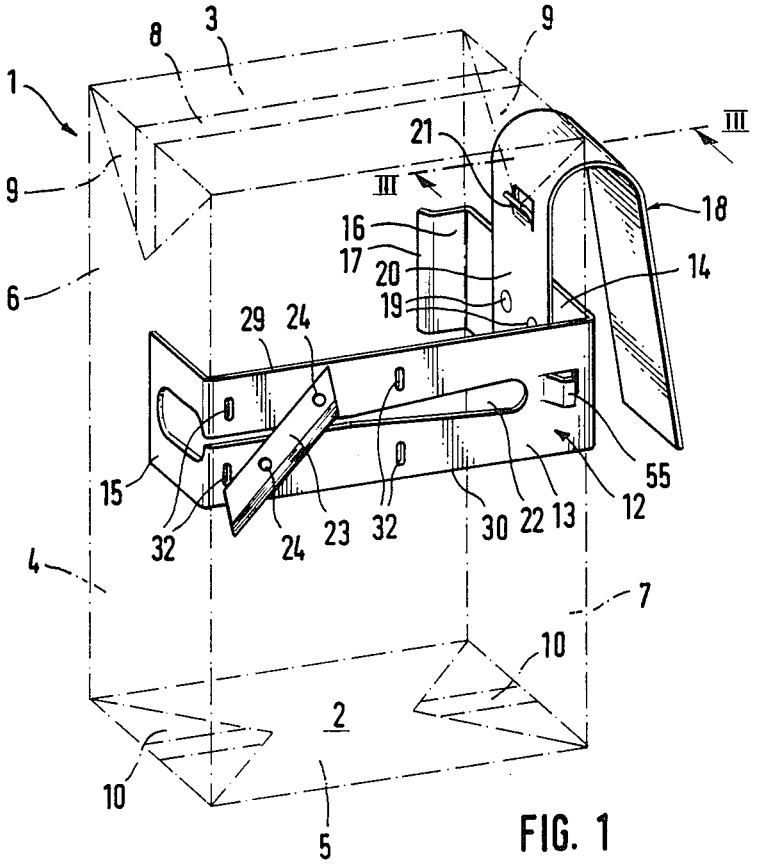
FIG. 1 is a perspective view of a first embodiment of the present invention in a position of use on a container.

A packaging container 1 indicated in FIG. 1 has a parallelepiped shape, which is formed of two frontal surfaces 2 and 3, two wider lateral surfaces 4 and 5 and two narrower lateral surfaces 6 and 7. The two frontal surfaces 2 and 3 each have a folded closure 8, which can be sealed by bonding. As a result of the fact that the packaging carton is produced from a single pre-cut piece, laterally projecting corners, each resulting in a folded triangle 9 (frontal surface 3) or 10 (frontal surface 2), are produced when the folded closure 8 is formed; these rest against the narrow lateral surfaces 6 and 7 in the case of front surface 3, and against the frontal surface 2 itself in the case of frontal surface 2, and are attached there, e.g., by gluing. To open the container 1, a folded triangle 9 is loosened from its attachment, bent upwards in the direction of the arrow 11 (FIG. 2) and then cut off. The contents of the container can then be removed, e.g., poured out.

The device which serves for this and further handling of the packaging container 1 consists of a frame, designed generally as 12, a longer section 13 of which rests against one wide lateral surface 5 and a shorter section 14 of which rests against one narrow lateral surface 7 of the packaging carton 1, over the entire width of these surfaces. Adjacent sections 13, 14 are two short frame sections 15 and 16, respectively, which rest against only part of the lateral surfaces 6 and 4, respectively. The short section 16 of the frame 12 is bent away from carton 1 at a free end 17. A handle, generally designated as 18, is attached to section 14 of frame 12 at 19. Handle 18 projects beyond the plane of the frame 12 and has a back 20 which projects upwardly and rests against the narrow lateral surface 7 of the parallelepiped in the FIG. 1 embodiment. A catch 21 is formed on back 20. Catch 21 engages under the folded triangle 9 of the carton 1 in the position of use as shown, so that the carton cannot slip in a downward direction when being held by the frame 12. The frame 12 and the handle 18 can be stamped from a bar of sheetmetal in the embodiment according to FIGS. 1 to 3. They can consist of a single piece.

The longer section 13 of the frame 12 has a guide slit 22 formed therein. Guide slit 22 continues into the short frame section 15 and is wider there. A knife blade 23 crosses the guide slit 22 at an angle of approximately 45°; in the embodiment according to FIGS. 1 and 2, it is attached to the section 13 by a rivet or screw attachment 24.

Figure 7:
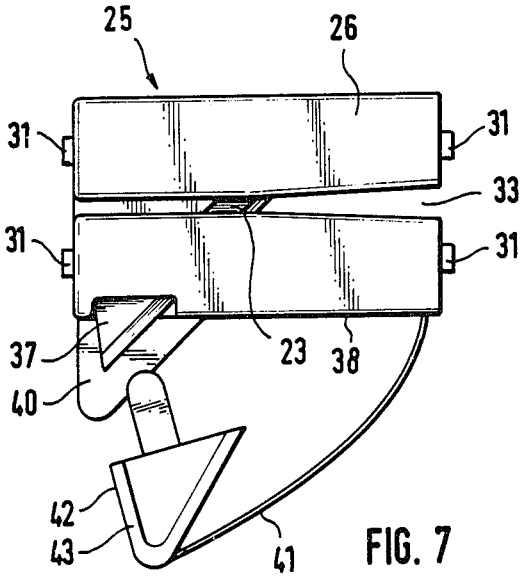
FIG. 7 is a top view of an alternative knife holder.
Figure 8:
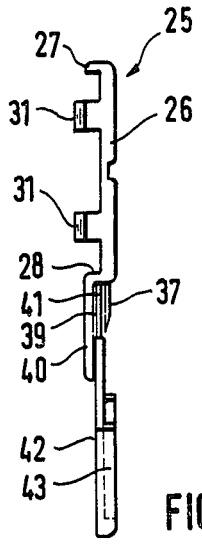
FIG. 8 is a side view of the knife holder taken in the direction of the arrow VIII in FIG. 7.

The knife blade 23 can alternatively, however, be attached to a knife holder, generally designated as 25, in a particularly advantageous embodiment, as illustrated in FIGS. 7 and 8. The knife holder 25 is attached to the outside of the section 13 which has the guide slit 22. A base plate 26 has an upper edge strip 27 and a lower edge strip 28, which project respectively beyond an upper edge 29 and a lower edge 30 of the frame section 13. Catch elements 31 are molded onto the base plate 26 for engagement with corresponding openings 32 of section 13. The base plate 26 of the knife holder 25 is provided with a slit 33, which essentially corresponds with the guide slit 22 in the section 13. The knife bldde 23 is provided with two bores 34 in this embodiment, with corresponding tabs 35 on the inside 36 of the base plate 26 passing through them. Lower end 37 of the knife blade 23 projects beyond lower edge 38 of the base plate 26 of the knife holder 25. At a distance 39, there is a protective surface 40 behind the projecting end 37 of the knife blade, molded onto the base plate 26, which projects beyond the contours of the blade end 37. Furthermore, a protective cap 42 is molded onto the base plate 26 by way of a molded connector 41, which cap can be inserted into the slit 39 between the blade end 37 and the protective surface 40 of the knife holder 25. Cap 42 has ribs 43 on its outer edge, which surround the blade end 37 protectively in the inserted position.

The knife holder of FIGS. 7 and 8 can be clipped onto the outside of the section 13 of the frame 12, instead of the knife 23 directly and rigidly being attached as in the embodiment according to FIG. 1. The FIGS. 7 and 8 knife holder is preferably made of plastic, by an injection molding process.

Figure 4:
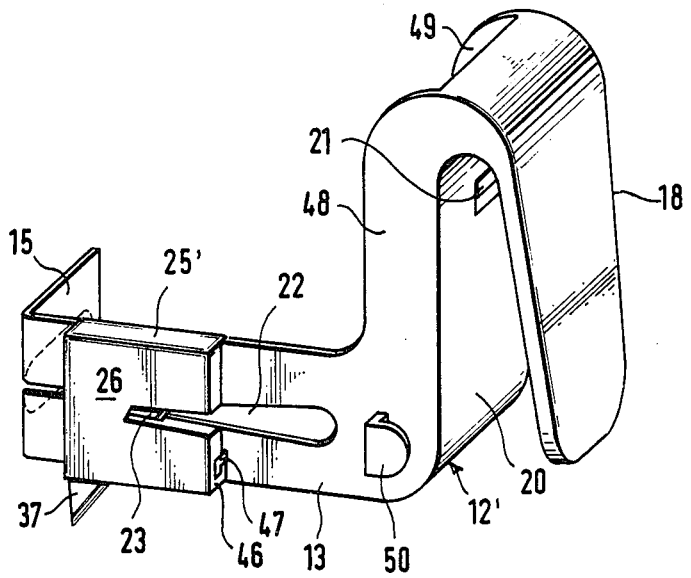
FIG. 4 is a perspective view of a second embodiment.
Figure 5:
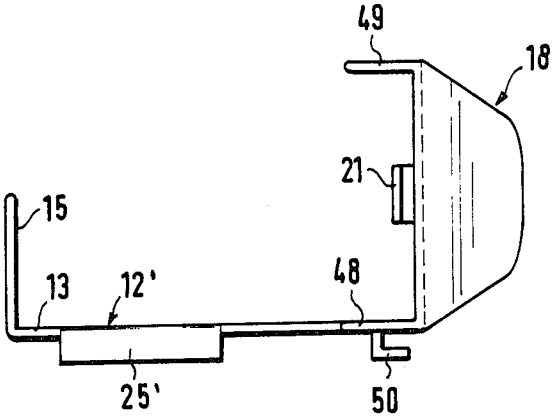
FIG. 5 is a top view of the FIG. 4 embodiment.
Figure 6:
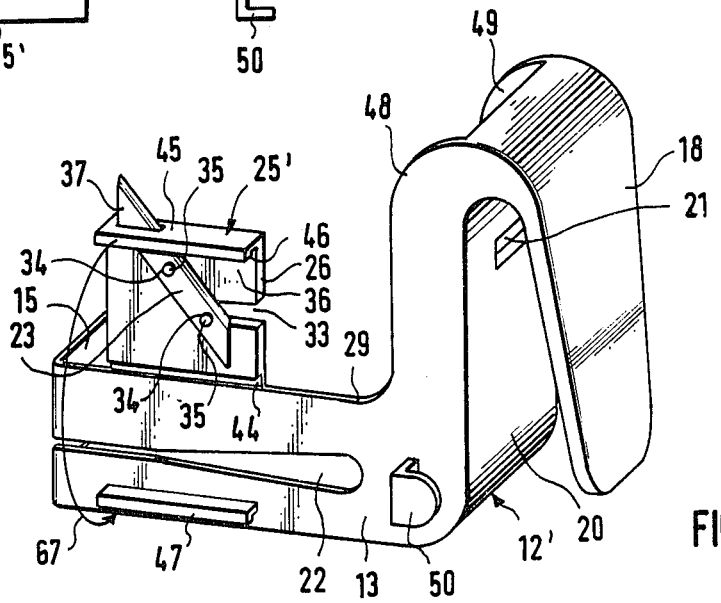
FIG. 6 is the device according to FIG. 4 with the knife holder flipped open.

Another embodiment of a frame and knife holder is shown in FIGS. 4 to 6, in connection with a frame 12' made of plastic. In FIG. 6, knife holder 25' is produced in one piece with the frame 12' and is molded onto the upper edge 29 of the section 13 of the frame 12' by way of a film hinge 44. On an edge 45 of the knife holder 25', which is the upper edge in the open position according to FIG. 6, there is a catch 46, which acts together with a countercatch 47 on the outside of the section 13, when the knife holder 25' is pivoted about hinge 44 and clipped onto frame section 13 in the direction of the arrow 67.

In the embodiment shown in FIGS. 4 to 6, which is preferably produced by a plastic injection molding process, the back 20 of the handle 18 is provided with lateral cheeks 48 and 49, which rest against the two opposing lateral surfaces 4 and 5 of the parallelelepiped. The cheek 49 thereby fulfills the function of the short frame section 16 in the embodiment according to FIG. 1 At the outside of the section 13 of the frame 12', a hook 50 is arranged, which is stamped and bent out in the sheet-metal embodiment, and molded on in the plastic embodiment according to FIG. 6. Hook 50 serves to tear a folded triangle 9 attached to the folded carton 1 loose from its attachment and to lift it up into the cutting position shown in FIG. 2.

Figure 9:
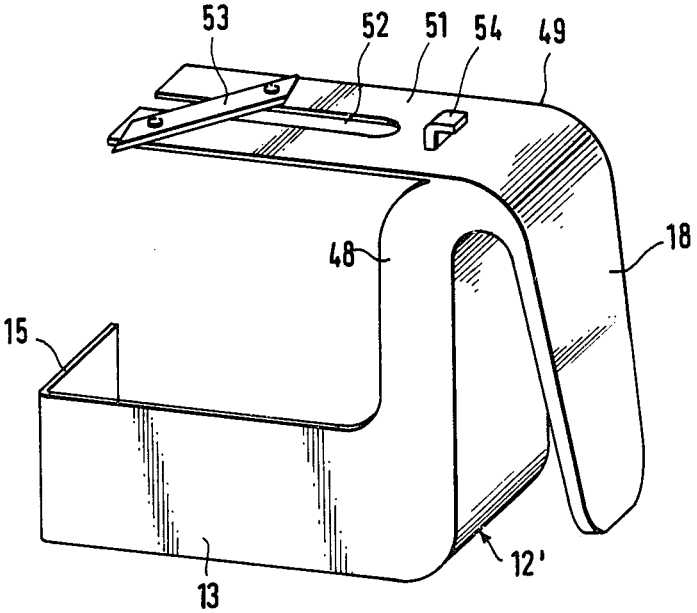
FIG. 9 is yet another embodiment of the device.

FIG. 9 shows an embodiment changed insofar as an additional section 51 is arranged on the frame 12', which rests against the upper frontal surface 3 of the packaging carton in its position of use and which has guide slit 52 with knife 53. Here again, the knife blade 53 can, of course, be attached using a knife holder 25. A hook 54 of section 51 corresponds to the corresponding hook 50 of the embodiment according to FIG. 6.

Figure 2:
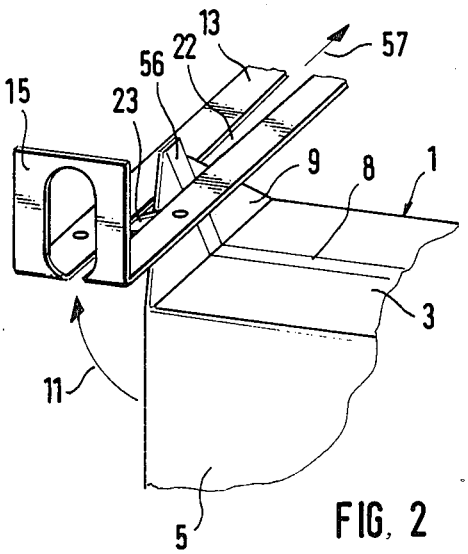
FIG. 2 is a partial view of the FIG. 1 device during use of the cutting device.
Figure 3:
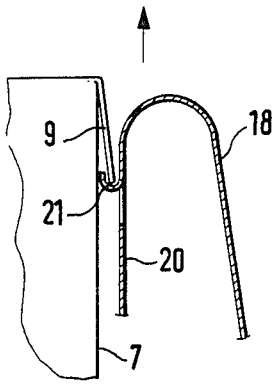
FIG. 3 is a cross-section along the line III—III of FIG. 1.

To use the device, the user grasps handle 18 and first tears one of the folded triangles 9 loose, using hook 50 or 54, and bends it into the position shown in FIG. 2. Tip 56 of folded triangle 9 is then inserted through guide slit 22 or 52, and is cut off with the knife blade 23 by pulling the device approximately in the direction of the arrow 57 shown in FIG. 2. The packaging container 1 is now open. The frame 12 is then passed over the packaging carton 1, for example from the top. When this is done, the catch 2l on the back 20 of the handle glides along the lateral surface 7 of the parallelepiped until it is below the folded triangle 9 which rests against this lateral surface. By reversing direction and slightly lifting frame 12, the catch 21 engages under the folded triangle 9, in the area of its tip and thereby holds the frame 12 securely in relation to the packaging carton 1. It is also possible, on the otherhand, to push the frame 12 over the packaging carton from below, i.e., to place the latter into the frame from above. Here again, the two elements are brought together until the catch 21 engages with the corresponding folded triangle 9 of the carton 1.

What is claimed is:

1. A device for handling a packaging container having a parallelepiped shape and made of cardboard or a similar material, said container having four lateral surfaces, a top surface, a bottom surface and a folded closure on said top surface, said closure having a pair of opposite outer corners forming a pair of outer triangles each having a tip and a base, each said base corresponding to an edge of said top surface and said outer triangles being folded over said edges of said top surface, whereby each of said outer triangles extends downwardly along a lateral surface of said container and said tip is attached to said lateral surface, said packaging container handling device comprising a frame having four frame sections for surrounding said container at least partially on said four lateral surfaces, a handle connected to said frame at a first of said four frame sections and extending approximately perpendicularly from said frame, said handle including a catch for engaging underneath a folded triangle of said container extending downwardly along said lateral surface of said container, a guide slit in said frame for receiving and holding a portion of an outer triangle of said closure after said outer triangle is detached from said lateral surface, and a cutting blade overlapping said guide slit for cutting off the portion of said outer triangle received and held in said guide slit, said guide slit and cutting blade being arranged on at least a second frame section other than said first frame section connected to said handle.

2. A packaging container handling device as in claim 1, wherein two frame sections are adapted to rest against entire widths of first and second lateral surfaces of said container and another two frame sections are adapted to rest against only a portion of entire widths of third and fourth lateral surfaces of said container.

3. A packaging container handling device as in claim 1, wherein said first frame section connected to said handle is adapted to rest against an entire width of a lateral surface of said container.

4. A packaging container handling device as in claim 1, further comprising a fifth frame section extending from said handle for resting against said top surface of said container, said guide slit and said cutting blade being arranged on said fifth frame section.

5. A packaging container handling device as in claim 1, wherein said second frame section having arranged thereon said guide slit and cutting blade is adapted to rest against an entire width of a lateral surface of said container.

6. A packaging container handling device as in claim 5, wherein said guide slit extends from said second frame section adapted to rest against an entire width of a container lateral surface into an adjacent third frame section adapted to rest against a portion of an entire width of a container lateral surface.

7. A packaging container handling device as in claim 1, wherein a third frame section is adapted to rest against a portion of an entire width of a lateral surface of said container and terminates in a free end extending outwardly from said frame, whereby when said frame surrounds said container, said free end extends away from said container.

8. A packaging container handling device as in claim 1, wherein said cutting blade is arranged directly on said second frame section.

9. A packaging container handling device as in claim 1, further comprising a knife holder for holding said cutting blade, said knife holder being arranged directly on said second frame section for arranging said cutting blade thereon.

10. A packaging container handling device as in claim 9, further comprising a hinge for pivotally connecting said knife holder to said second frame section, whereby said knife holder and cutting blade can be pivoted between an open position for cutting off said portion of said outer triangle and a closed position adjacent said second frame section and means for affixing said knife holder in the closed position to said frame section.

11. A packaging container handling device as in claim 10, wherein said hinge is a film hinge.

12. A packaging container handling device as in claim 9. wherein said knife holder is formed integrally with said second frame section.

13. A packaging container handling device as in claim 9, wherein said second frame section includes a longitudinal edge, said cutting blade includes first and second contours, said first contour projecting beyond said longitudinal edge, and said knife holder includes a protective surface spaced from said cutting blade between said cutting blade and said second frame section, said protective surface extending substantially parallel to said cutting blade and having first and second contours projecting beyond the first and second contours of said cutting blade.

14. A packaging container handling device as in claim 13, further comprising a protective cap for covering said projecting cutting blade, said protective cap including parallel spaced ribs for surrounding said projecting cutting blade, and means arranged between said protective surface and said cutting blade for securing said protective cap to said knife holder.

15. A packaging container handling device as in claim 9, wherein said frame and handle comprise plastic.

16. A packaging container handling device as in claim 1, wherein said cutting blade is removable from said frame.

17. A packaging container handling device as in claim 1, wherein said second frame section includes a longitudinal edge, and said cutting blade projects beyond said longitudinal edge.

18. A packaging container handling device as in claim 17, further comprising a protective cap for covering said projecting cutting blade.

19. A packaging container handling device as in claim 1, further comprising a hook arranged on one of said frame sections for grasping, tearing loose and flipping up a folded outer triangle of said container.

20. A packaging container handling device as in claim 1, wherein said frame and handle comprise a shaped sheet-metal bar.

* * * * *